US009941601B2

(12) United States Patent
Kawamura et al.

(10) Patent No.: US 9,941,601 B2
(45) Date of Patent: Apr. 10, 2018

(54) TERMINAL, WIRE HARNESS, AND WIRE-HARNESS STRUCTURE

(71) Applicants: Furukawa Electric Co., Ltd., Tokyo (JP); Furukawa Automotive Systems Inc., Inukami-gun (JP)

(72) Inventors: Yukihiro Kawamura, Inukami-gun (JP); Takashi Tonoike, Inukami-gun (JP); Mikio Kuwahara, Inukami-gun (JP); Ryusuke Terashima, Inukami-gun (JP)

(73) Assignees: FURUKAWA ELECTRIC CO., LTD, Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 15/088,425

(22) Filed: Apr. 1, 2016

(65) Prior Publication Data

US 2016/0218442 A1 Jul. 28, 2016

Related U.S. Application Data

(63) Continuation of application No. PCT/JP2014/077385, filed on Oct. 15, 2014.

(30) Foreign Application Priority Data

Oct. 15, 2013 (JP) ..... 2013-214652
Oct. 15, 2013 (JP) ..... 2013-214672

(51) Int. Cl.
*H01R 4/18* (2006.01)
*H01R 13/187* (2006.01)
(Continued)

(52) U.S. Cl.
CPC ..... *H01R 4/18* (2013.01); *H01R 4/183* (2013.01); *H01R 4/20* (2013.01); *H01R 13/187* (2013.01);
(Continued)

(58) Field of Classification Search
CPC . H01R 4/18; H01R 4/20; H01R 4/188; H01R 4/203; H01R 4/206; H01R 4/62; H01R 13/187
(Continued)

(56) References Cited

U.S. PATENT DOCUMENTS 8,974,258 B2 * 3/2015 Mitose ..... H01R 4/184 439/877
2002/0077001 A1 6/2002 Chen
(Continued)

FOREIGN PATENT DOCUMENTS

EP 1 215 765 A2 6/2002
EP 2 555 328 A1 2/2013
(Continued)

OTHER PUBLICATIONS

International Search Report dated Jan. 6, 2015 in PCT/JP2014/077385, filed Oct. 15, 2014 (with English Translation).
(Continued)

*Primary Examiner* — Renee S Leubke
*Assistant Examiner* — Paul Baillargeon
(74) *Attorney, Agent, or Firm* — Oblon, McClelland, Maier & Neustadt, L.L.P.

(57) ABSTRACT

A transition portion (4) has a surface (14) that is formed extending upward. The surface (14) is a surface formed extending upward so as to face a bottom portion (6*a*). Specifically, the transition portion (4) has a cross-sectional shape in which upper edge portions of side portions (8*a*) are bent inward. As the surface (14) approaches a main terminal
(Continued)

body (3) from a sealing portion (22), the surface (14) gradually separates away from the bottom portion (6*a*) and the edge portions of the surface (14) gradually open outward and connect to side portions (8*b*) of the main terminal body (3). The surface (14) is formed so as to be curved upward, in a cross-section, from the end portion of the sealing portion (22).

8 Claims, 15 Drawing Sheets

(51) Int. Cl.

| | |
|---|---|
| ***H01R 4/20*** | (2006.01) |
| ***H01R 43/00*** | (2006.01) |
| *H01R 4/62* | (2006.01) |
| *H01R 13/11* | (2006.01) |

(52) U.S. Cl.
CPC ..... *H01R 43/005* (2013.01); *H01R 4/188* (2013.01); *H01R 4/62* (2013.01); *H01R 13/11* (2013.01)

(58) Field of Classification Search
USPC ..... 439/877, 741, 519, 604, 587
See application file for complete search history.

(56) References Cited

U.S. PATENT DOCUMENTS

| | | | |
|---|---|---|---|
| 2010/0210148 | A1 | 8/2010 | Fukase |
| 2013/0045644 | A1 | 2/2013 | Aoki et al. |

FOREIGN PATENT DOCUMENTS

| | | |
|---|---|---|
| JP | 2002-184479 | 6/2002 |
| JP | 2004-71437 | 3/2004 |
| JP | 2004-111058 | 4/2004 |
| JP | 2006-331931 | 12/2006 |
| JP | 2010-186692 | 8/2010 |
| JP | 2013-62206 | 4/2013 |
| WO | WO 2011/122622 A1 | 10/2011 |
| WO | 2014/129229 | 1/2014 |

OTHER PUBLICATIONS

Extended European Search Report dated May 26, 2017 in European Patent Application No. 14854866.2.
Office Action dated Feb. 19, 2018 in European Patent Application No. 14854866.2.

* cited by examiner

TERMINAL, WIRE HARNESS, AND WIRE-HARNESS STRUCTURE

TECHNICAL FIELD

The present invention relates to a wire harness or the like that is used in automobiles or the like.

BACKGROUND ART

Conventionally, as a connection between an electric wire and a terminal in an automotive wire harness, a crimp joint is generally used in which a so-called open-barrel terminal is crimped with an electric wire. However, in this type of wire harness, when moisture or the like attaches to a connecting portion between the electric wire and the terminal, a surface of a metal used in the electric wire is subject to oxidization, and resistance in a joining portion increases. Further, when metals used in the electric wire and the terminal are different from each other, galvanic corrosion occurs. The progress of the corrosion of the metal materials in the connecting portion causes cracking or a contact failure of the connecting portion, and inevitably has an impact on the product life. Particularly, in recent years, a wire harness that uses an electric wire formed of an aluminum alloy and a terminal formed of a copper alloy is being commercialized, so the problem relating to the corrosion of the joining portion is becoming more notable.

Here, when moisture attaches to a contact portion between dissimilar metals, such as aluminum and copper, for example, so-called electrolytic corrosion may occur, due to the difference in corrosion potential. In particular, since the potential difference between aluminum and copper is large, the corrosion occurs on the aluminum side, which is electrically less noble. Accordingly, a connection state between the conducting wire and the crimping terminal becomes unstable, and there is a risk that an increase in contact resistance, or an increase in electrical resistance due to a decrease in a wire diameter may be caused, and further, a malfunction or a breakdown of an electrical component may occur as a result of a break in the wire.

Examples of this type of wire harness in which dissimilar metals come into contact with each other include a wire harness which is filled with a resin material so as to cover the connecting portion between the electric wire and the crimping terminal (Patent Document 1). The wire harness filled with the resin material inhibits moisture from attaching to the contact portion between the electric wire and the crimping terminal.

Further, a method has been proposed in which a terminal including a one end-closed cylindrical crimp portion is used, and an end portion of an electric wire is inserted into the cylindrical crimp portion, and then the cylindrical crimp portion is crimped by crimping so as to protect an end portion of a core wire from attachment of rain water, sea water, and the like (Patent Document 2).

CITATION LIST

Patent Literature

Patent Document 1: Japanese Unexamined Patent Application Publication No. 2004-111058A Patent Document 2: Japanese Unexamined Patent Application Publication No. 2006-331931A

SUMMARY OF INVENTION

Technical Problem

However, in the method disclosed in Patent Document 1, filling with the resin material has to be performed separately. As a result, a problem arises in which the manufacturing process becomes more complex, and accordingly, control of the manufacturing process also becomes more complex. Further, as a result of the process becoming more complex, the overall cost of the wire harness also increases.

Further, when the end portion of the crimp portion is sealed, as described in Patent Document 2, strength between the terminal portion and the crimp portion becomes insufficient, and the wire harness may become damaged at a time of manufacturing or when using the wire harness.

In light of the above, an object of the present invention is to provide a terminal capable of improving strength of a transition portion, a wire harness using the terminal, and a wire harness structure.

Solution to Problem

A first aspect of the present invention to achieve the above-described object is a terminal to be connected with a coated conducting wire. The terminal includes a main terminal body and a cylindrical crimp portion integrally formed with a transition portion placed therebetween, the crimp portion being sealed except for a section thereof into which the coated conducting wire is inserted. A surface is formed on at least a part of the transition portion, the surface extending continuously from a sealing portion provided on the transition portion side toward side portions of the main terminal body. A bottom portion of the transition portion and the surface separate from each other as the bottom portion of the transition portion and the surface approach the side portions of the main terminal portion from the sealing portion.

It is preferable that the sealing portion be formed of an upper plate and a lower plate that are stacked on each other, and the surface be formed as a result of the upper plate, forming the sealing portion, being formed integrally with and continuously to the side portions of the main terminal body. It is preferable that the surface be a curved surface being curved upward in a cross section.

The sealing portion that is an end portion of the crimp portion and is provided on the transition portion side is sealed over an entire width of the crimp portion, and, in a plan view, an edge portion of the sealing portion on the transition portion side may be formed so that a central section of the sealing portion in a width direction protrudes toward the transition portion side with respect to both sides of the sealing portion in the width direction.

In the side portions of the main terminal body, a notch may be formed in at least a part of a section between a connecting portion of the main terminal body with the transition portion and an upper portion of the main terminal body.

The notch may be formed continuously from side surfaces of the main terminal body up to an upper surface of the main terminal body.

According to the first aspect of the present invention, it is possible to improve the strength of the transition portion by forming the surface that is formed continuously from the sealing portion to the side surfaces of the main terminal body and by causing the surface to rise up so that the surface gradually separates away from the bottom portion of the transition portion.

At this time, by forming a shape of the surface to be curved upward or downward, a stress concentration section is less likely to be formed, and it is thus possible to reliably achieve an effect of improving the strength.

Further, by forming a shape of the sealing portion so that a central portion thereof protrudes toward the transition portion side, it is possible to form the rise of the above-described surface in a gradual manner.

Further, because, in the connecting portion from the transition portion to the main terminal body, the notch is formed in the side surfaces of the main terminal body, it is possible to eliminate a steep rise of side surfaces of the transition portion. Accordingly, a distance between an upper edge portion of the main terminal body and the sealing portion becomes long, and it is thus possible to alleviate stress concentration. Further, as a result of forming the notch, it becomes unnecessary to make a length of the transition portion long, and it is thus possible to inhibit an entire length of the terminal from becoming long.

The above-described notch may be formed continuously up to the upper portion of the main terminal body. As a result, it is possible to further alleviate the stress concentration at a time of molding or using the terminal.

A second aspect of the present invention is a wire harness including a coated conducting wire and a terminal connected with each other. The terminal includes a main terminal body and a cylindrical crimp portion integrally formed with a transition portion placed therebetween, the crimp portion being sealed except for a section thereof into which the coated conducting wire is inserted, and the coated conducting wire being crimped in the crimp portion. A curved surface is formed on at least a part of the transition portion, the curved surface extending continuously from a sealing portion provided on the transition portion side toward side portions of the main terminal body. A bottom portion of the transition portion and the curved surface separate away from each other as the bottom portion of the transition portion and the curved surface approach the side portions of the main terminal portion from the sealing portion.

The sealing portion that is an end portion of the crimp portion and is provided on the transition portion side is sealed over an entire width of the crimp portion, and, in a plan view, an edge portion of the sealing portion on the transition portion side may be formed so that a central section of the sealing portion in a width direction protrudes toward the transition portion side with respect to both sides of the sealing portion in the width direction.

In the side portions of the main terminal body, a notch may be formed in at least a part of a section between a connecting portion of the main terminal body with the transition portion and an upper portion of the main terminal body.

A conducting wire of the coated conducting wire may be formed of an aluminum-based material.

According to the second aspect of the present invention, it is possible to improve the strength of the transition portion by forming the surface that extends continuously from the sealing portion to the side surfaces of the main terminal body and by causing the surface to rise up so that the surface gradually separates away from the bottom portion of the transition portion.

Further, by forming the shape of the sealing portion so that the central portion thereof protrudes toward the transition portion side, it is possible to form the rise of the above-described surface in a gradual manner and to inhibit the terminal from being damaged.

Further, due to the notch, it is possible to inhibit the stress from being concentrated in a rising portion extending from the sealing portion to the main terminal body without making the length of the terminal long.

A third aspect of the present invention is a wire harness structure in which a plurality of wire harnesses are bundled together. The wire harness includes a coated conducting wire and a terminal connected with each other. The terminal includes a main terminal body and a cylindrical crimp portion integrally formed with a transition portion placed therebetween, the crimp portion being sealed except for a section thereof into which the coated conducting wire is inserted. A curved surface is formed on at least a part of the transition portion, the curved surface extending continuously from a sealing portion provided on the transition portion side toward side portions of the main terminal body. A bottom portion of the transition portion and the curved surface separate from each other as the bottom portion of the transition portion and the curved surface approach the side portions of the main terminal portion from the sealing portion.

In the present invention, it is also possible to use a plurality of wire harnesses bundled together.

Advantageous Effects of Invention

According to the present invention, it is possible to provide a terminal capable of improving strength of a transition portion, a wire harness using the terminal, and a wire harness structure.

BRIEF DESCRIPTION OF DRAWINGS

FIG. 4A is a perspective view illustrating a state before the crimping process, and FIG. 4B is a perspective view illustrating a state after the crimping process.

DESCRIPTION OF EMBODIMENTS

First Embodiment

Figure 1:
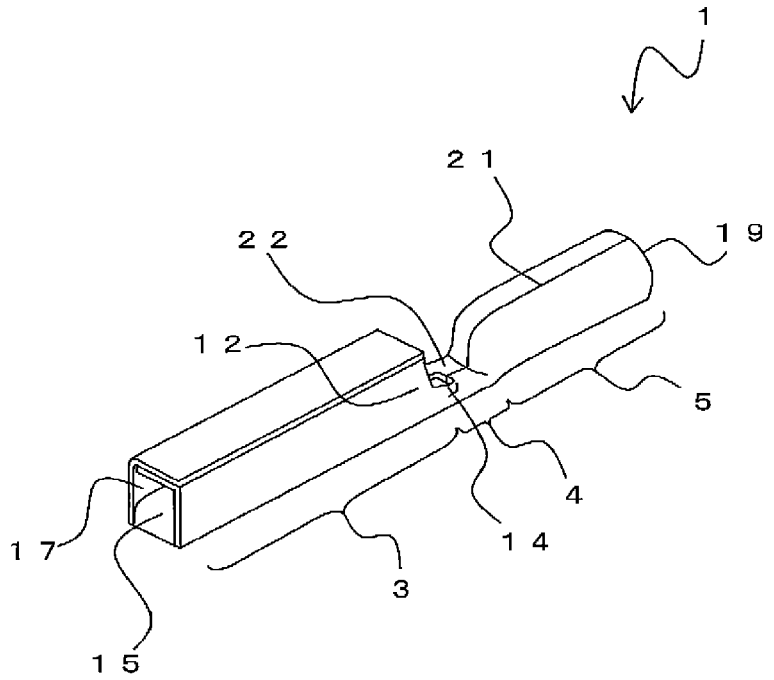
FIG. 1 is a perspective view of a terminal 1.

A first embodiment of the present invention will be described below in detail with reference to the accompanying drawings. FIG. 1 is a perspective view of a terminal 1, and FIG. 2A is a vertical cross-sectional view of the terminal 1.

Figure 2A:
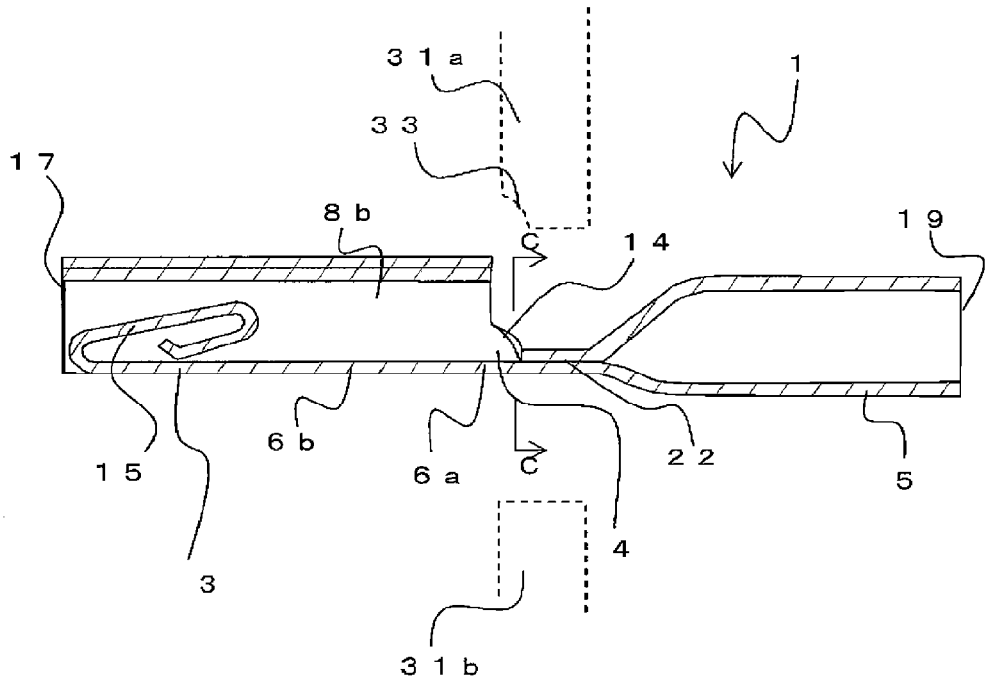
FIG. 2A is a vertical cross-sectional view of the terminal 1.

As illustrated in FIGS. 1 and 2A, the terminal 1 is formed by a main terminal body 3 and a crimp portion 5. A section between the main terminal body 3 and the crimp portion 5 forms a transition portion 4. The transition portion 4 is formed continuously from a sealing portion 22 to at least a bottom portion and a side portion of the main terminal body 3.

The terminal 1 is formed of copper. The main terminal body 3 is formed by shaping a plate material of a predetermined shape into a cylindrical body having a rectangular cross-section. The main terminal body 3 has an elastic contact piece 15 formed in a front end portion 17 by bending the plate material back into the rectangular cylindrical body. The main terminal body 3 is caused to be connected as a result of a male terminal or the like being inserted from the front end portion 17.

The crimp portion 5 is integrally formed by being rolled into a cylindrical body having a circular cross-section, and by adjacent side edge portions being butt joined at a joining portion 21. Note that, in the description below, a side on which the adjacent edge portions of the crimp portion 5 are joined (an upper side in FIG. 2A) will be regarded as an upward direction of the terminal, and the opposite surface side (a lower side in FIG. 2A) will be regarded as a downward direction of the terminal. A coated conducting wire 23, which will be described below, is inserted from a rear end portion 19 of the crimp portion 5 that is formed in the cylindrical shape. Further, the sealing portion 22 is provided in a front end portion (on the main terminal body 3 side) of the crimp portion 5. The sealing portion 22 is sealed so that the bottom portion of the main terminal body 3 (a lower plate) and a plate portion on an upper surface side (an upper plate) are overlapped with each other. Specifically, the crimp portion 5 is sealed except for the rear end portion 19 into which the coated conducting wire 23 is inserted. Note that the joining portion 21 and the sealing portion 22 are welded using laser welding or the like, for example.

Figure 2B:
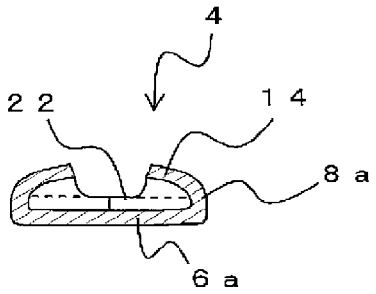
FIG. 2B is a cross-sectional view taken along a line C-C of FIG. 2A.

The transition portion 4 has a surface 14 that is formed extending upward. FIG. 2B is a cross-sectional view taken along a line C-C of FIG. 2A. The surface 14 is a surface (a curved surface) formed extending upward (toward the upper side) so as to face a bottom portion 6*a*. Specifically, the transition portion 4 has a cross-sectional shape in which upper edge portions of side portions 8*a* are bent inward.

As the surface 14 approaches the main terminal body 3 from the sealing portion 22, the surface 14 gradually separates away from the bottom portion 6*a* (the lower plate), that is, increases the distance therebetween, and edge portions of the surface 14 gradually open outward, and an upper plate of the sealing portion 22 is integrated continuously with a side portion 8*b* of the main terminal body 3. Specifically, the surface 14 faces upward in a boundary section with the sealing portion 22, and the surface 14 faces sideward in a boundary section with the side portion 8*b* (a surface (normal line) direction of the surface 14 rotates approximately 90 degrees in a section between the sealing portion 22 and the side portion 8*b*). In other words, when the surface direction of the upper plate of the sealing portion 22 is set as a reference, the rotational angle of the surface direction of the surface 14 from the boundary section with the sealing portion 22 constantly changes (increases) depending on a distance from the sealing portion 22. Further, in cross-section, the surface 14 is formed in an inclined manner, so as to be curved upward from an end portion of the sealing portion 22. In order to curve the surface 14 upward in this manner, it is sufficient that a notch 33 corresponding to the shape of the surface 14 is formed in part of metal dies 31*a* and 31*b* that are used to crush the upper plate and a lower plate of the sealing portion 22 (FIG. 2A).

Figure 3A:
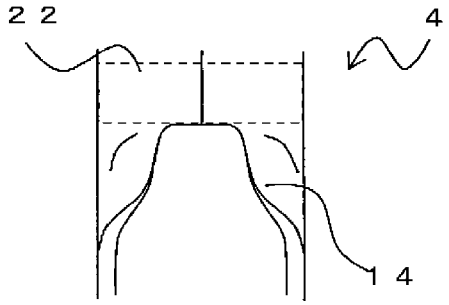
FIGS. 3A and 3B are plan views of a transition portion 4.
Figure 3B:
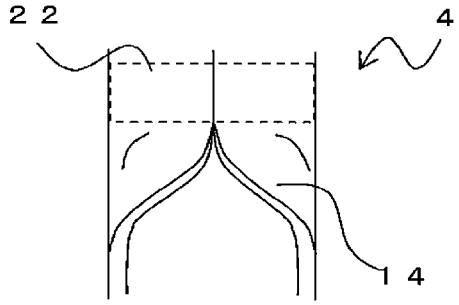

FIGS. 3A and 3B are partial plan views of the transition portion 4. From the end portion of the sealing portion 22 toward the main terminal body 3 side (toward the lower side in the drawings), the surface 14 gradually widens outward while gradually separating away from the bottom portion. At this time, as illustrated in FIG. 3A, an end portion of the surface 14 (a connecting portion with the sealing portion 22) may be placed at a position displaced outward from the center of the sealing portion 22, or as illustrated in FIG. 3B, the end portion of the surface 14 may be placed at substantially the center of the sealing portion 22.

As described above, a form of the surface 14 is not particularly limited, and it is sufficient as long as the bottom portion 6*a* and the surface 14 are in contact with each other at the end portion of the sealing portion 22, and that an upper surface of the bottom portion 6*a* and a lower surface of the surface 14 gradually separate away from each other as they approach the main terminal body 3. Further, in the end portion of the sealing portion 22, it is sufficient as long as the surface 14 and the bottom portion 6*a* are substantially in parallel with each other, and the edge portion of the surface 14 gradually rises up outward as the surface 14 approaches the main terminal body 3, so as to become continuous with the side portion 8*b*.

Figure 4A:
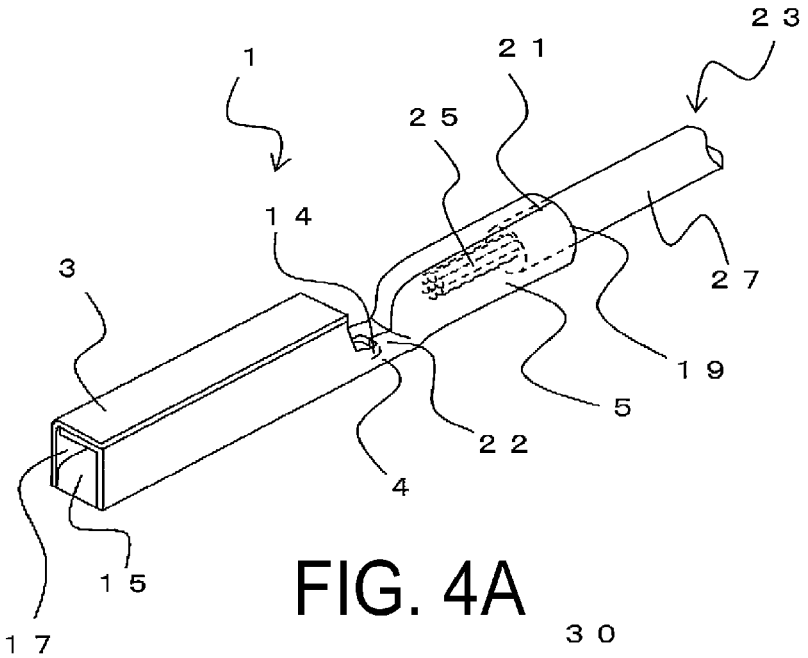
FIGS. 4A and 4B are diagrams illustrating a crimping process of a wire harness, where
Figure 4B:
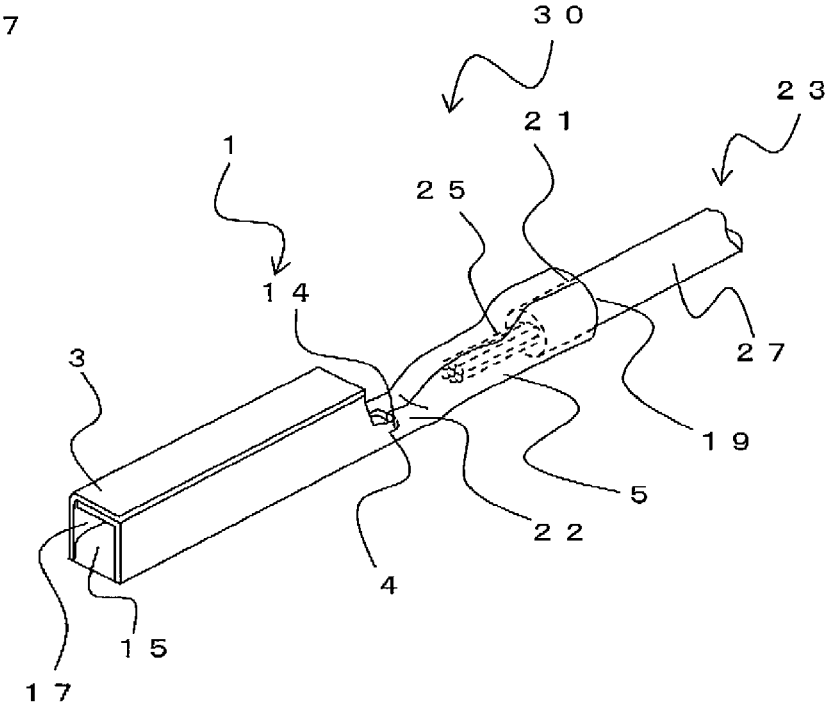

Next, a process of forming a wire harness will be described. FIGS. 4A and 4B are diagrams illustrating a process of connecting the terminal 1 with the coated conducting wire 23. First, as illustrated in FIG. 4A, the coated conducting wire 23 is inserted into the cylindrical crimp portion 5. As described above, the crimp portion 5 is rolled into a substantially cylindrical shape, and the adjacent side edge portions thereof are joined at the joining portion 21. Further, the sealing portion 22 is provided in the front end portion (on the main terminal body 3 side) of the crimp portion 5. Specifically, the crimp portion 5 is sealed except for the rear end portion 19 into which the coated conducting wire 23 is inserted.

In the coated conducting wire 23, a conducting wire 25 is coated by an insulating coating portion 27. The conducting wire 25 is formed of an aluminum-based material, for example. When the coated conducting wire 23 is inserted into the crimp portion 5, the coating portion 27 on a part of a tip of the coated conducting wire 23 is peeled off so as to cause the conducting wire 25 to be exposed. Note that materials that are normally used in this technical field, such as polyvinyl chloride (PVC), and polyethylene, can be selected as the coating portion 27.

Next, as illustrated in FIG. 4B, the crimp portion 5 is compressed by a metal die, which is not illustrated in the drawing. Accordingly, the crimp portion 5 is crimped with the conducting wire 25 and the coating portion 27. After being crimped, the crimp portion 5 can be sealed as a result of the crimp portion 5 and the coating portion 27 being brought into close contact with each other. At this time, other sections of the crimp portion 5 apart from the rear end portion 19 are sealed by the joining portion 21 and the sealing portion 22 and become watertight, and it is thus possible to inhibit water from penetrating into the crimp portion 5. A wire harness 30 is manufactured in the above-described manner.

According to the present embodiment, because the surface 14 is provided in the section between the sealing portion 22 and the main terminal body 3, the strength of the transition portion 4 is improved. Thus, it is possible to inhibit the transition portion 4 from being damaged when the terminal 1 is molded or used.

Second Embodiment

Figure 5:
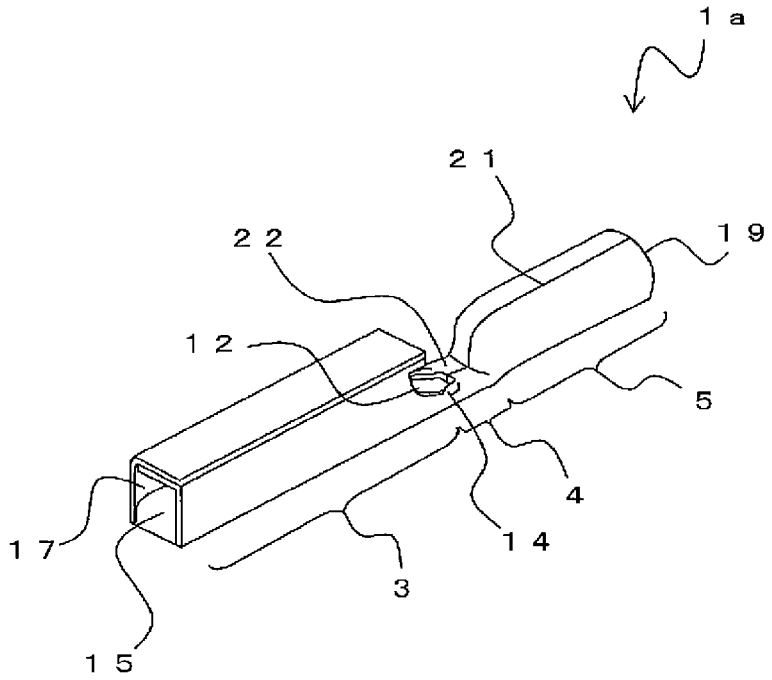
FIG. 5 is a perspective view of a terminal 1*a*.
Figure 6A:
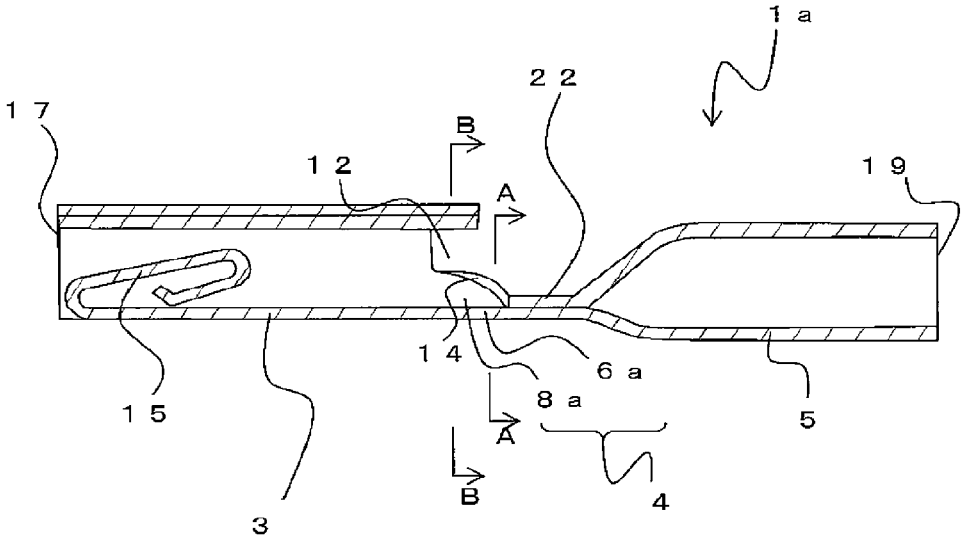
FIG. 6A is a vertical cross-sectional view of the terminal 1*a*.

Next, a second embodiment will be described below. FIG. 5 is a perspective view of a terminal 1*a* according to the second embodiment, and FIG. 6A is a vertical cross-sectional view of the terminal 1*a*. Note that, in the description below, constituent elements which serve the same function as in the terminal 1 will be assigned the same reference numerals as in FIG. 1 and other drawings, and redundant descriptions of those constituent elements will be omitted.

Although the terminal 1*a* has substantially the same configuration as the terminal 1, the terminal 1*a* is different in that a notch 12 is formed in part of side surfaces of the main terminal body 3. The transition portion 4 is formed so as to be connected to the notch 12 from the end portion of the sealing portion 22 (the transition portion 4 side) via the surface 14. Specifically, the bottom portion of the transition portion 4 is continuous with the bottom portion of the main terminal body 3. At least part of side portions of the transition portion 4 and the surface 14 that rise up from the sealing portion 22 are continuous with the side portions 8*b* of the main terminal body 3.

Figure 6B:
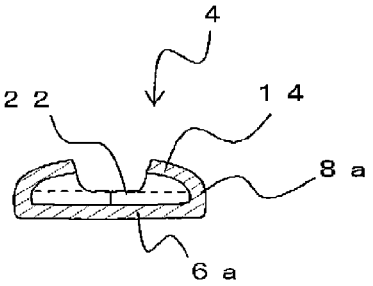
FIG. 6B is a cross-sectional view taken along a line A-A of FIG. 6A.
Figure 6C:
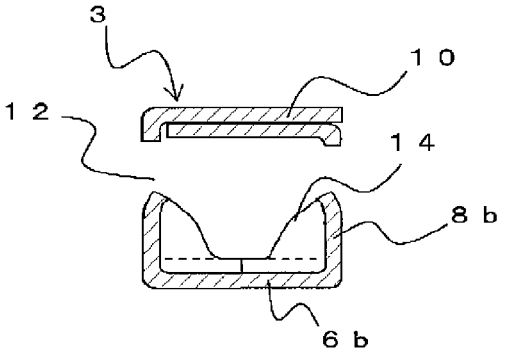
FIG. 6C is a cross-sectional view taken along a line B-B of FIG. 6A.

FIG. 6B is a cross-sectional view taken along a line A-A of FIG. 6A, and FIG. 6C is a cross-sectional view taken along a line B-B of FIG. 6A. In an illustrated example, the bottom portion 6*a* of the transition portion 4 and a bottom portion 6*b* of the main terminal body 3 are formed continuously. Further, the side portions 8*a* of the transition portion 4, and the surface 14 gradually rise up from the sealing portion 22 side, and become continuous with the notch 12 formed in the side portions 8*b* of the main terminal body 3.

Here, when side surfaces (wall surfaces) of the transition portion 4 rise up steeply from the sealing portion 22 and connects to the side surfaces or the upper surface of the main terminal body 3, large stress may be generated in the steeply rising portion of the side surfaces of the transition portion 4, at a time when the terminal is molded or used.

On the other hand, when a distance from the sealing portion 22 to the main terminal body 3 is made long by causing the transition portion 4 to rise up gradually from the sealing portion 22 to the main terminal body 3, it is possible to alleviate stress concentration in the transition portion 4. However, required lengths of the main terminal body 3 and the crimp portion 5 are prescribed, and when connectivity is taken into account, the upper surface of the main terminal body 3 needs to have the prescribed length. Specifically, it is not possible to shorten only the main terminal body 3. Therefore, when the transition portion 4 is caused to rise up gradually, there arises a problem in which an entire length of the terminal becomes long.

In response to this, by providing the notch 12, it is possible to make gradual, rather than steep, a rise of the portion that extends from the end portion of the sealing portion 22 (the end portion on the transition portion 4 side) to the main terminal body 3. Accordingly, at a time when the terminal is molded or used, it is possible to alleviate the stress concentration occurring at the boundary between the transition portion 4 and the main terminal body 3 that is caused by a force generated in the main terminal body 3.

Further, by forming the notch 12 in the side portions 8*b* of the main terminal body 3, it is possible to inhibit the entire length of the terminal 1 from becoming long, even when the rise of the transition portion 4 is made gradual.

According to the second embodiment, the same effect as in the first embodiment can be achieved. Further, because the notch 12 is provided in the side portions 8*b* of the main terminal body 3, it is possible to cause the rise from the side portions 8*a* to the side portions 8*b* to be gradual in the transition portion 4. Specifically, a steep rise from the end portion of the sealing portion 22 toward an upper portion of the main terminal body 3 (a substantially perpendicular rise with respect to the bottom portion 6*a*) is never formed. Thus, the distance between the main terminal body 3 and the sealing portion 22 becomes longer, and it is possible to inhibit stress concentration from occurring in a base portion of the transition portion 4 (in the vicinity of the boundary section with the sealing portion 22) and in the vicinity of the upper portion of the main terminal body 3 caused by the force applied to the main terminal body 3.

At this time, because the gradual rise of the transition portion 4 is continuous with the notch 12, a length of the terminal 1 does not become long.

Further, by providing the notch 12, the surface 14 can be formed more easily. Furthermore, the rise of the surface 14 does not become steep.

Note that a shape of the notch 12 is not limited to the shapes illustrated in FIGS. 6A, 6B, and 6C, or other drawings. Specifically, the notch 12 need not necessarily be formed in the side portions 8*b* so as to reach the upper portion of the main terminal body from the lower portions of the side portions 8*b*, as illustrated in FIGS. 6A, 6B, and 6C, and the notch 12 may take other forms.

Figure 7:
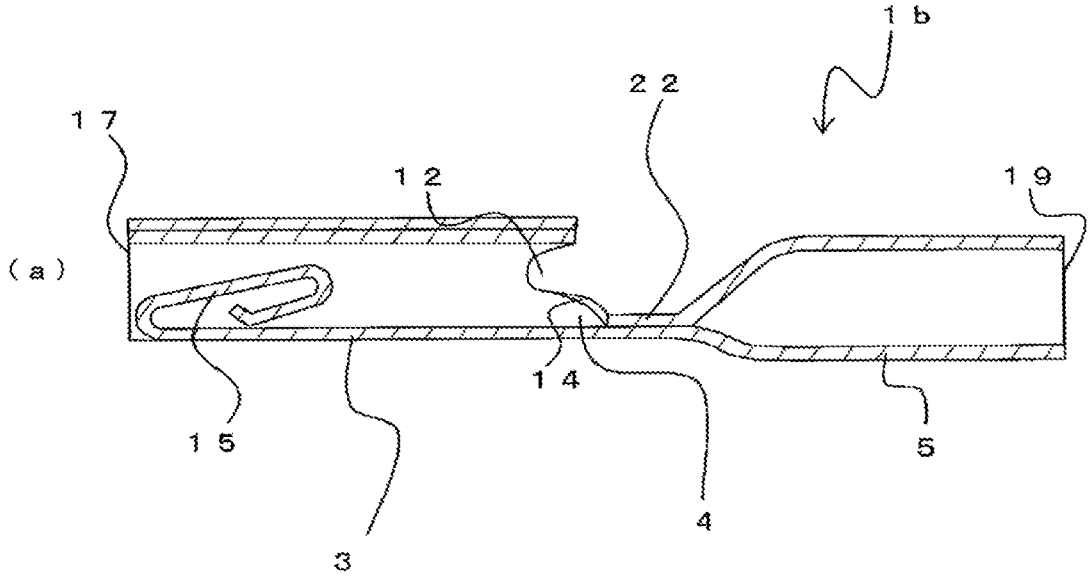
FIG. 7 is a vertical cross-sectional view of a terminal 1*b*.

For example, as in a terminal 1*b* illustrated in FIG. 7, the notch 12 need not necessarily be formed so as to reach the upper portion of the main terminal body 3, but may be formed by cutting off parts of the side portions 8*b* so that the notch 12 is connected with an edge portion of the upper portion of the main terminal body 3 (an upper edge portion on the transition portion 4 side).

Figure 8:
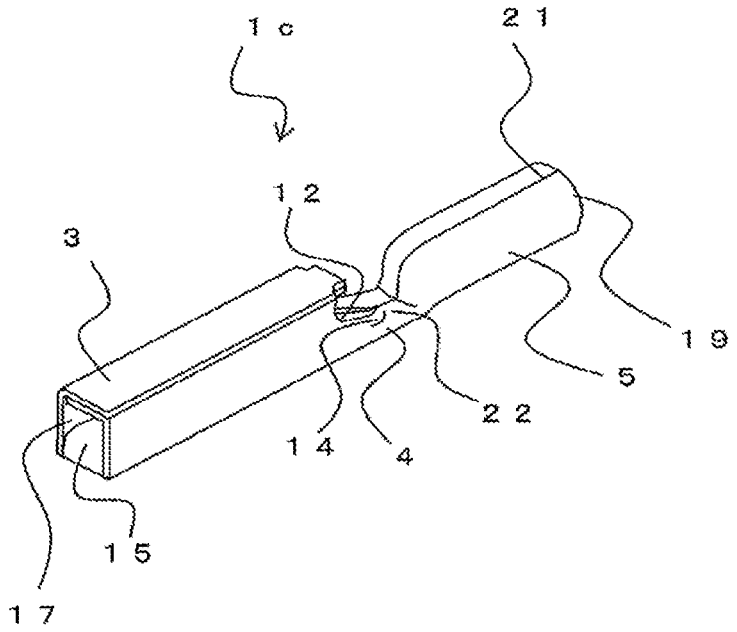
FIG. 8 is a perspective view of a terminal 1*c*.

Further, as in a terminal 1*c* illustrated in FIG. 8, the notch 12 need not necessarily be formed in only the side portions 8*b*, but may be formed continuously from the side portions 8*b* to the upper portion of the main terminal body 3. Specifically, the notch 12 may be formed continuously from the side surfaces of the main terminal body 3 up to the upper surface of the main terminal body 3, and a part of the upper portion of the main terminal body 3 may be cut out to form a notch. In this manner, even when the notch 12 is formed in part of the side portions and the upper portion of the main terminal body 3 while securing the length of the main terminal body 3, the same effect can be achieved. In the present invention, the form of the notch 12 may be any one of the forms described above. However, it is preferable that the shape of the notch 12 be formed by a curved line that is curved as gently as possible.

Figure 9:
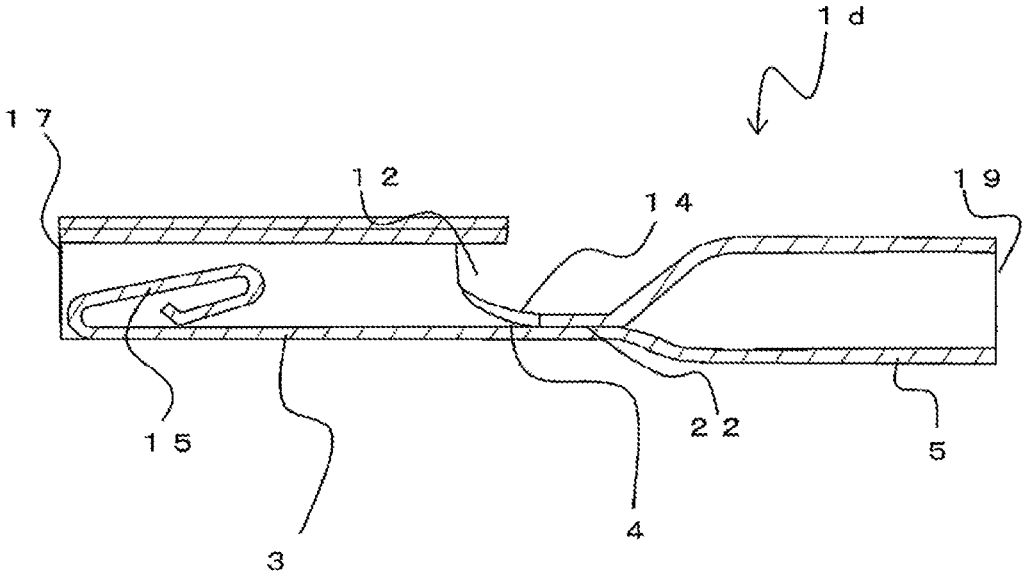
FIG. 9 is a vertical cross-sectional view of a terminal 1*d*.

Further, the shape of the surface 14 is not also limited to the shapes illustrated in FIG. 2 or other drawings. For example, as in a terminal 1*d* illustrated in FIG. 9, the surface 14 may be formed so as to be curved downward. In this case, it is only required to use a sealing metal die corresponding to the curved shape. By adopting the above-described curved shape, it is possible to improve the strength of the transition portion 4 more efficiently.

Figure 10:
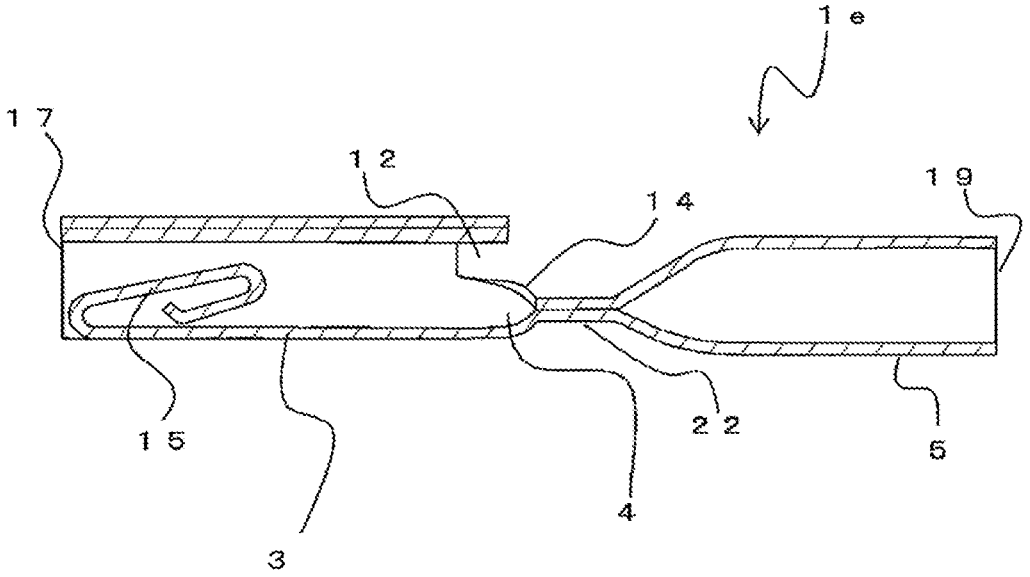
FIG. 10 is a vertical cross-sectional view of a terminal 1*e*.

Further, as in a terminal 1*e* illustrated in FIG. 10, the shape of the surface 14 need not necessarily be formed on only the upper surface of the transition portion 4, but may be also formed on a lower surface of the transition portion 4. Specifically, the surface 14 may be formed so that the bottom portion 6*a* expands downward as the surface 14 approaches the main terminal body 3 from the sealing portion 22. Specifically, the bottom portion 6*a* and the bottom portion 6*b* need not necessarily be formed so as to be straight, but may be formed so that the surface 14 and the bottom portion 6*a* each expand upward and downward starting from the sealing portion 22.

Third Embodiment

Figure 11A:
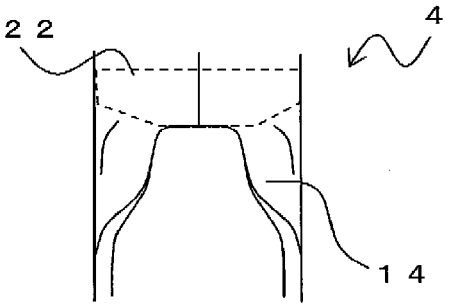
FIGS. 11A and 11B are plan views of the transition portion 4, illustrating other forms of a sealing portion 22.
Figure 11B:
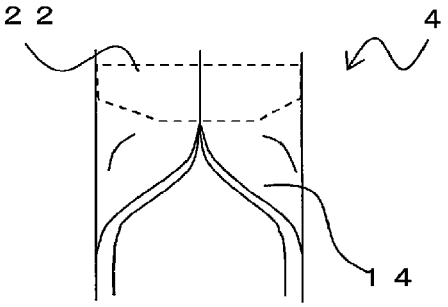

Next, a third embodiment will be described. FIGS. 11A and 11B are partial plan views of the transition portion 4. In the third embodiment, the sealing portion 22 has a different shape. Specifically, in the above-described example, as illustrated in FIGS. 3A and 3B, the sealing portion 22 is formed over an entire section in a width direction (a left and right direction in the drawings) of the terminal 1. Further, the sealing portion 22 is formed in a rectangular shape with a substantially uniform length (a length in the up and down direction in the drawings) over the entire width thereof.

In contrast, in the present embodiment, a form of the sealing portion 22 changes depending on the width position. In examples illustrated in FIGS. 11A and 11B, the sealing portion 22 takes a form in which a section around a central portion of the sealing portion 22 in the width direction protrudes toward the transition portion 4 with respect to both end portions of the sealing portion 22 in the width direction. Specifically, the sealing portion 22 has a tapered shape so that a sealing length gradually becomes shorter from the section in the vicinity of the central portion toward both the end portions of the sealing portion 22. Note that the tapered shape may be formed in a straight line or a curved line.

According to the third embodiment, substantially the same effect as in the first embodiment can be achieved. Further, by causing the sealing length in the vicinity of both the end portions of the sealing portion 22 in the width direction to be shorter, the above-described surface 14 can be formed more easily. Further, it is possible to cause the form in which the surface 14 gradually separates away from the bottom portion 6*a*, from the sealing portion 22 side toward the main terminal body 3, to become gentler in the vicinity of both the end portions of the sealing portion 22.

Furthermore, because the sealing length that can achieve reliable sealing is secured for the substantially central portion of the sealing portion 22, it is possible to secure the watertightness of the crimp portion 5.

Figure 12:
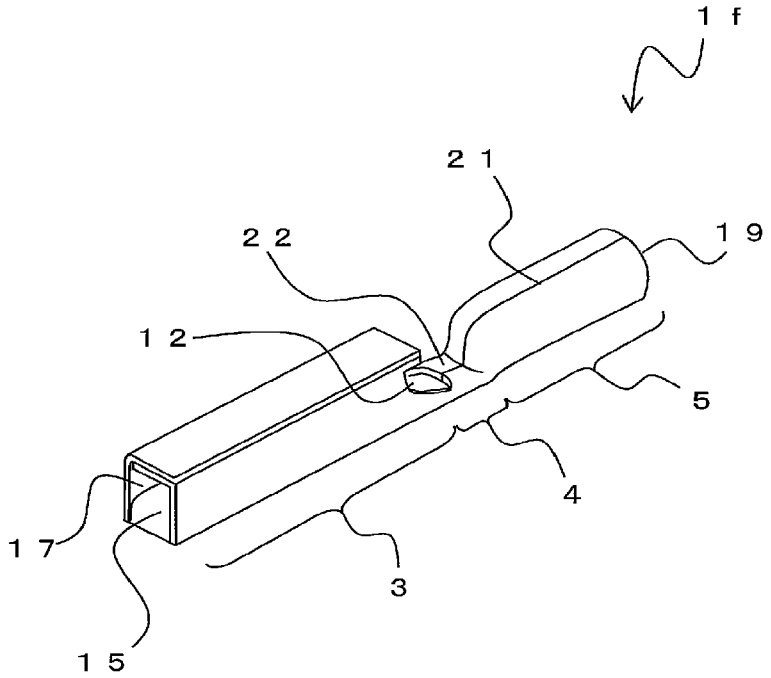
FIG. 12 is a perspective view of a terminal 1*f*.
Figure 13A:
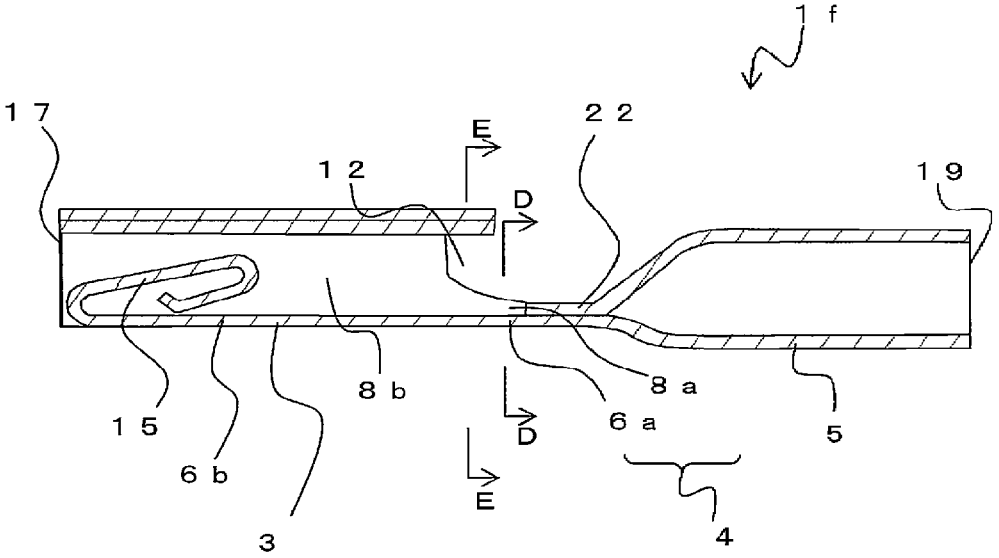
FIG. 13A is a vertical cross-sectional view of the terminal 1*f*.

Note that it is also possible to form only the notch 12 without forming the surface 14. FIG. 12 is a perspective view of a terminal 1*f*, and FIG. 13A is a vertical cross-sectional view of the terminal 1*f*. As illustrated in FIG. 12 and FIG. 13A, the terminal 1*f* has substantially the same configuration as the terminal 1, except that the surface 14 is not formed. Further, the process of forming the wire harness is also the same.

The notch 12 is provided in part of the side surfaces of the main terminal body 3. The transition portion 4 is formed to connect to the notch 12 from the end portion of the sealing portion 22 (on the transition portion 4 side). Specifically, the bottom portion of the transition portion 4 is continuous with the bottom portion of the main terminal body 3, and at least a part of the side portions of the transition portion 4 that rises up from the sealing portion 22 is continuous with the side portions of the main terminal body 3. Note that the form of the sealing portion 22 may be as illustrated in FIG. 3A, 3B, 11A, or 11B.

Figure 13B:
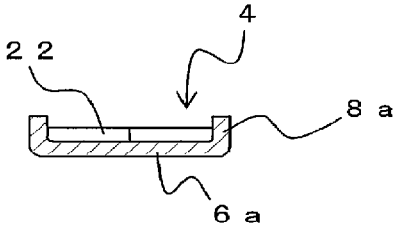
FIG. 13B is a cross-sectional view taken along a line D-D of FIG. 13A.
Figure 13C:
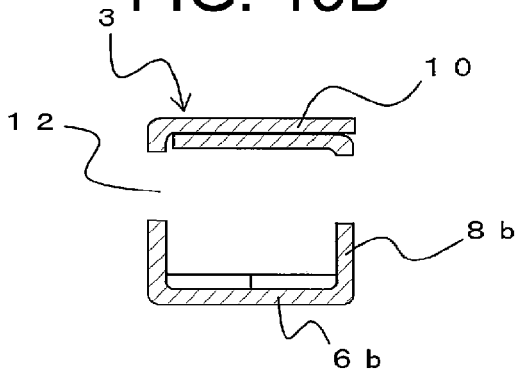
FIG. 13C is a cross-sectional view taken along a line E-E of FIG. 13A.

FIG. 13B is a cross-sectional view taken along a line D-D of FIG. 13A, and FIG. 13C is a cross-sectional view taken along a line E-E of FIG. 13A. In an illustrated example, the bottom portion 6*a* of the transition portion 4 and the bottom portion 6*b* of the main terminal body 3 are formed continuously. Further, the side portions 8*a* of the transition portion 4 gradually rise up from the sealing portion 22 side, and become continuous with the notch 12 formed in the side portions 8*b* of the main terminal body 3.

By providing the notch 12 in this manner, it is possible to make gradual, rather than steep, the rise of the portion that extends from the end portion of the sealing portion 22 (the end portion on the transition portion 4 side) to the main terminal body 3. Accordingly, at a time of molding or using the terminal, it is possible to alleviate the stress concentration that occurs at the boundary between the transition portion 4 and the main terminal body 3 as a result of the force generated in the main terminal body 3.

At this time, by forming the notch 12 in the side portions 8*b* of the main terminal body 3, it is possible to inhibit the entire length of the terminal 1 from becoming long, even when the rise of the transition portion 4 is made gradual.

Note that the shape of the notch 12 is not limited to shapes illustrated in FIGS. 13A, 13B, 13C and other drawings. Specifically, the notch 12 need not necessarily be formed in the side portions 8*b* so as to reach the upper portion of the main terminal body from the lower portions of the side portions 8*b*, as illustrated in FIGS. 13A, 13B, and 13C, and the notch 12 may take other forms.

Figure 14A:
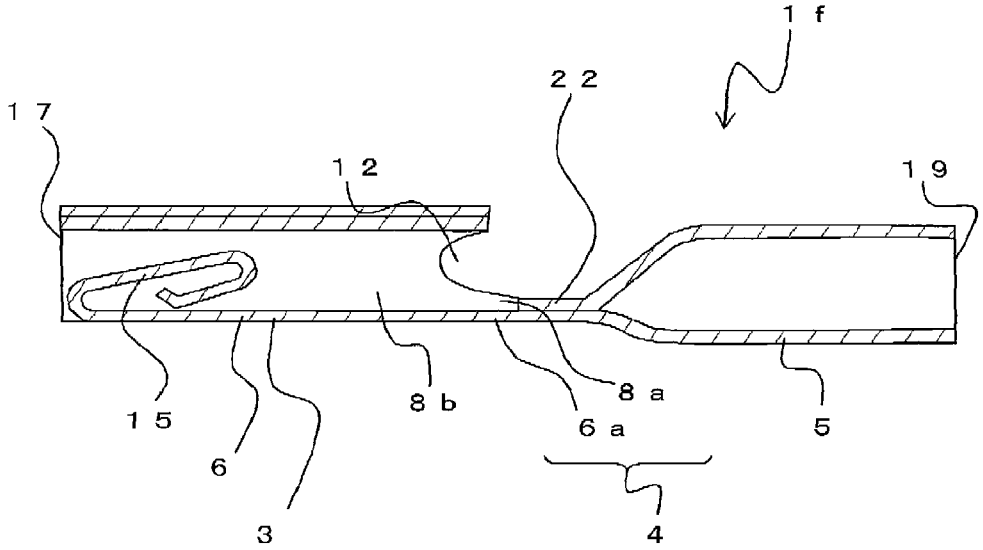
FIGS. 14A and 14B are diagrams illustrating other modes of a notch 12.
Figure 14B:
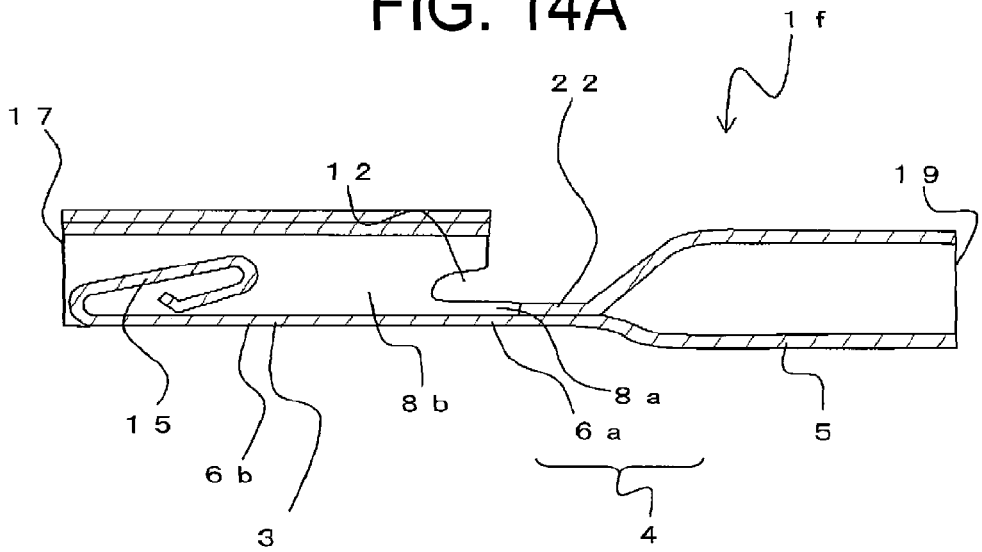

For example, as illustrated in FIG. 14A, the notch 12 need not necessarily be formed to reach the upper portion of the main terminal body 3, and may be formed by cutting off parts of the side portions 8*b* so that the notch 12 is connected with the edge portion of the upper portion of the main terminal body 3 (the upper edge portion on the transition portion 4 side). Further, as illustrated in FIG. 14B, even when the notch 12 is formed in only part of the side portions 8*b* without connecting the notch 12 with the upper portion of the main terminal body 3, the intended effect can be achieved.

Figure 15:
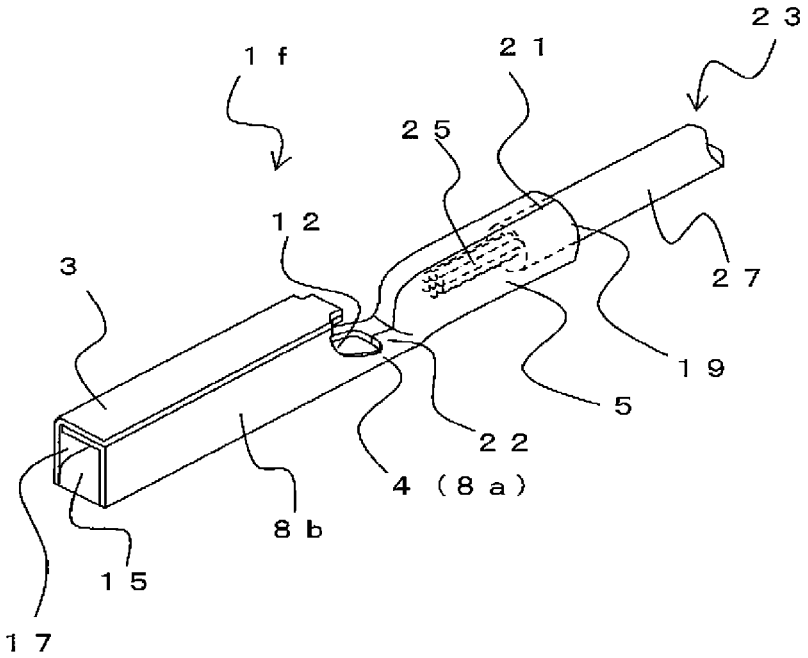
FIG. 15 is a perspective view of another mode of the terminal 1*f*.

Further, as illustrated in FIG. 15, the notch 12 need not necessarily be formed in only the side portions 8*b*, and may be formed continuously from the side portions 8*b* to the upper portion of the main terminal body 3. Specifically, the notch 12 may be formed continuously from the side surfaces of the main terminal body 3 up to the upper surface of the main terminal body 3, and a part of the upper portion of the main terminal body 3 may be cut out to form a notch. In this manner, even when the notch 12 is formed in part of the side portions and the upper portion of the main terminal body 3 while securing the length of the main terminal body 3, the same effect can be achieved. Accordingly, in the present invention, the form of the notch 12 may be any one of the forms described above. However, it is preferable that the shape of the notch 12 be formed of a curved line that is curved as gently as possible.

According to the above-described terminal 1*f*, it is possible to alleviate the stress in the transition portion and to shorten the entire length of the terminal.

Although embodiments of the present invention have been described above with reference to the accompanying drawings, the technical scope of the present invention is not affected by the above-described embodiments. It will be apparent to those skilled in the art that various variations and modifications can be made to the present invention within the scope of the technical ideas described in the appended claims. Thus, it is intended that these variations and modifications are within the technical scope of the present invention.

For example, although aluminum is used for the electric wire in the working examples, the present invention is not limited to those examples, and copper may be used for the electric wire. Similarly, the terminal is not limited to a copper terminal, and a terminal formed of copper alloy or a terminal having its surface plated with tin or the like may be used. Further, it is needless to say that each of the above-described embodiments can be combined with one another in the present invention.

Further, a plurality of the wire harnesses according to the present invention may be bundled together and used. In the present invention, a structure in which the plurality of wire harnesses are bundled together in this manner is called a wire harness structure.

REFERENCE SIGNS LIST

1, 1*a*, 1*b*, 1*c*, 1*d*, 1*e*, 1*f* Terminal
3 Main terminal body
4 Transition portion
5 Crimp portion
6*a*, 6*b* Bottom portion
8*a*, 8*b* Side portion
12 Notch
14 Surface
15 Elastic contact piece
17 Front end portion
19 Rear end portion
21 Joining portion
22 Sealing portion
23 Coated conducting wire
25 Conducting wire
27 Coating portion
30 Wire harness
31*a*, 31*b* Metal die
33 Notch

The invention claimed is:

1. A terminal that is crimped when connected with a coated conducting wire, the terminal comprising:

a main terminal body and a cylindrical crimp portion integrally formed with a transition portion placed therebetween, the crimp portion before being crimped to the coated conducting wiring is sealed except for a section thereof into which the coated conducting wire is inserted, a surface being formed on at least a part of the transition portion, the surface extending continuously from a sealing portion provided on the transition portion side of the crimp portion toward side portions of the main terminal body, and a bottom portion of the transition portion and the surface separating from each other as the bottom portion of the transition portion and the surface approach the side portions of the main terminal portion from the sealing portion.

2. The terminal according to claim 1, wherein the sealing portion is formed of an upper plate and a lower plate that are stacked on each other, and the surface is formed as a result of the upper plate, forming the sealing portion, being formed integrally with and continuously to the side portions of the main terminal body.

3. The terminal according to claim 1, wherein the surface is a curved surface curved upward in a cross section.

4. The terminal according to claim 1, wherein the sealing portion that is an end portion of the crimp portion and is provided on the transition portion side is sealed over an entire width of the crimp portion, and, in a plan view, an edge portion of the sealing portion on the transition portion side is formed so that a central section of the sealing portion in a width direction protrudes toward the transition portion side with respect to both sides of the sealing portion in the width direction.

5. The terminal according to claim 1, wherein the sealing portion is sealed so that side portions thereof are bent inward and the bottom portion of the main terminal body and a plate portion on an upper surface side are overlapped with each other.

6. The terminal according to claim 1, wherein in the side portions of the main terminal body, a notch is formed in at least a part of a section between a connecting portion of the main terminal body with the transition portion and an upper portion of the main terminal body.

7. The terminal according to claim 6, wherein the notch is formed in a section except the upper portion of the main terminal body.

8. A wire harness, comprising:

a coated conducting wire and a terminal connected with each other, the terminal including a main terminal body and a cylindrical crimp portion integrally formed with a transition portion placed therebetween, the crimp portion being sealed except for a section thereof into which the coated conducting wire is inserted, the coated conducting wire being crimped to the crimp portion, and a curved surface being formed on at least a part of the transition portion, the curved surface extending continuously from a sealing portion provided on the transition portion side of the crimp portion toward side portions of the main terminal body, wherein in the side portions of the main terminal body, a notch is formed in at least a part of a section between a connecting portion of the main terminal body with the transition portion and an upper portion of the main terminal body, as the curved surface approaches the main terminal body from the sealing, portion, the curved surface gradually separates away from a bottom portion of the transition portion, and edge portions of the curved surface gradually open outward, an upper plate of the sealing portion is integrated continuously with a side portion of the main terminal body so as to be connected to the notch, wherein the sealing portion that is an end portion of the crimp portion and is provided on the transition portion side is sealed over an entire width of the crimp portion, and, in a plan view, an edge portion of the sealing portion on the transition portion side is formed so that a central section of the sealing portion in a width direction protrudes toward the transition portion side with respect to both sides of the sealing portion in the width direction.

* * * * *